US007034261B2

(12) United States Patent
Suzuki

(10) Patent No.: US 7,034,261 B2
(45) Date of Patent: Apr. 25, 2006

(54) IMAGE HEATING APPARATUS OF ELECTROMAGNETIC INDUCTION HEATING TYPE

(75) Inventor: Hitoshi Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/121,019

(22) Filed: May 4, 2005

(65) Prior Publication Data

US 2005/0211701 A1 Sep. 29, 2005

Related U.S. Application Data

(62) Division of application No. 10/740,450, filed on Dec. 22, 2003.

(30) Foreign Application Priority Data

Dec. 24, 2002 (JP) ..... 2002-371969

(51) Int. Cl.
*H05B 6/14* (2006.01)
*G03G 15/20* (2006.01)

(52) U.S. Cl. ..... 219/619; 219/662; 219/676; 399/328; 399/330

(58) Field of Classification Search ..... 219/619, 219/656, 661–662, 670–676; 399/328–336
See application file for complete search history.

(56) References Cited

U.S. PATENT DOCUMENTS

| | | | | |
|---|---|---|---|---|
| 5,101,086 | A | 3/1992 | Dion et al. | |
| 5,239,347 | A | 8/1993 | Onodera et al. | 355/274 |
| 5,464,964 | A | 11/1995 | Okuda et al. | 219/497 |
| 5,534,987 | A | 7/1996 | Ohtsuka et al. | 355/285 |
| 5,552,582 | A | 9/1996 | Abe et al. | 219/619 |
| 5,666,627 | A | 9/1997 | Yamaguchi | 399/330 |
| 5,747,774 | A | 5/1998 | Suzuki et al. | 219/216 |
| 5,994,671 | A | 11/1999 | Suzuki et al. | 219/216 |
| 6,181,905 | B1 | 1/2001 | Ohta et al. | 399/328 |
| 6,373,036 | B1 | 4/2002 | Suzuki | 219/619 |
| 6,584,298 | B1 | 6/2003 | Omoto et al. | 399/330 |
| 6,713,734 | B1 | 3/2004 | Suzuki | 219/619 |
| 2002/0079312 | A1 | 6/2002 | Suzuki | 219/619 |
| 2003/0068169 | A1 | 4/2003 | Suzuki | 399/69 |

*Primary Examiner*—Philip H. Leung
(74) *Attorney, Agent, or Firm*—Fitzpatrick, Cella, Harper & Scinto

(57) ABSTRACT

The image heating apparatus includes a heating member, a first coil unit having a first holder in which a first excitation coil is sealed, the first excitation,coil being provided for generating a magnetic field to induce an eddy current in the heating member, and a second coil unit having a second holder in which a second excitation coil is sealed, the second excitation coil being provided for generating a magnetic field to induce an eddy current in the heating member. The image heating apparatus having such structure enables easy assembly work while being capable of conducting nonuniform heating.

4 Claims, 10 Drawing Sheets

IMAGE HEATING APPARATUS OF ELECTROMAGNETIC INDUCTION HEATING TYPE

This application is a divisional of U.S. patent application Ser. No. 10/740,450, filed Dec. 22, 2003, now allowed.

BACKGROUND OF THE INVENTION

1. Field of the Invention

The present invention relates to an image heating apparatus suitable as a heat-fixing apparatus mounted in an image forming apparatus such as a copying machine or a printer and, more particularly, to an image heating apparatus of electromagnetic induction heating type.

2. Related Background Art

A heating apparatus of electromagnetic induction heating type produces heat from an eddy current that is generated by placing an electroconductive member (e.g., an electromagnetic induction heat generating member, an inductive magnetic material, or an electroconductive material absorptive of magnetic fields) in a magnetic field. For example, this type of heating apparatus is effective, in an electrophotographic, electrostatic recording, magnetic recording, or other image forming apparatus, as a heat-fixing apparatus for heating a recording medium that carries an unfixed toner image and thus obtaining a permanently-fixed image through heat-fixing, or as an image heating apparatus for heating a sheet which has a porous macromolecular layer on the surface and on which an image is formed by ink-jet or other methods and thus melting the porous macromolecular layer for surface treatment.

In most image heating apparatuses of electromagnetic induction heating type, an excitation coil that serves as magnetic field generating means is placed inside a heating roller that is constituted of an electroconductive member (see Japanese Patent Application Laid-Open No. 2000-275991, for example).

FIG. 10 is a perspective view of an air-core coil used in a fixing apparatus that is disclosed in Japanese Patent Application Laid-Open No. 2000-275991.

In the prior art example given above, an excitation coil 2 that serves as magnetic field generating means is placed inside a heating roller, which is an electroconductive member.

The excitation coil 2 is a litz wire wound several times, and the litz wire is obtained by twisting together plural strands which are copper wires covered with polyamideimide. The litz wire is placed to line the inner wall of the fixing roller (heating roller) covering, on one side, about a 150° area out of the 360° central angle of the circular sectional shape of the fixing roller, and a twice larger area on both sides, namely, about a 300° area.

To manufacture this type of cylindrical coil whose litz wire covers most of the area in the circumferential direction of a fixing roller, a cylindrical winding jig is necessary and the litz wire is wound around the jig.

However, it is difficult to remove the coil from the jig if the coil actually covers the 300° area.

For that reason, the coil in the prior art example given above is composed of two parts which are semi-cylindrical coils formed separately and then connected to each other. The strands of one half coil are together connected to the strands of the other half coil at a single point in a junction portion 21, instead of connecting the strands one by one. In this way, work processes in the junction portion are reduced in number and secure connection is obtained.

With this structure, the winding jig can readily be removed after the litz wire is wound around the jig.

On the other hand, inserting the coil 2 into the fixing roller is not so easy since the strands of the coil are usually composed of copper wires, which lack rigidity. Although insertion of the coil into the fixing roller could be facilitated by attaching the coil to a holder, there is still a problem and the coil could be damaged if the coil bumps against the fixing roller. Furthermore, it is difficult to set the nonrigid coil in place while ensuring a desired distance between the coil and the fixing roller along the length of the fixing roller.

When the coil and the fixing roller are not spaced apart from each other as designed, temperature distribution on the fixing roller becomes uneven causing a failure in fixing toner in an electrophotographic process and uneven sheet surface treatment in an ink-jet process. In addition, the coil 2 obtained by joining two halves at the junction portion 21 is poor in mass-producibility and is difficult to handle.

SUMMARY OF THE INVENTION

The present invention has been made in view of the above problems, and an object of the present invention is therefore to provide an image heating apparatus that is easy to assemble.

Another object of the present invention is to provide an image heating apparatus that can suppress nonuniform heating.

Further, another object of the present invention is to provide, an image heating apparatus including:

a heating member;

a first coil unit having a first holder in which a first excitation coil is sealed, the first excitation coil being provided for generating a magnetic field to induce an eddy current in the heating member; and a second coil unit having a second holder in which a second excitation coil is sealed, the second excitation coil being provided for generating a magnetic field to induce an eddy current in the heating member.

The detailed description below, in conjunction with the accompanying drawings, will make other objects of the present invention clear.

DESCRIPTION OF THE PREFERRED EMBODIMENTS

Preferred embodiments of the present invention will be described in detail below with reference to the drawings. Note that the sizes, materials, and shapes of the structural components as well as their relative positions given in the following embodiments are not intended to limit the scope of the present invention unless specifically stated otherwise.

First Embodiment

Figure 1:
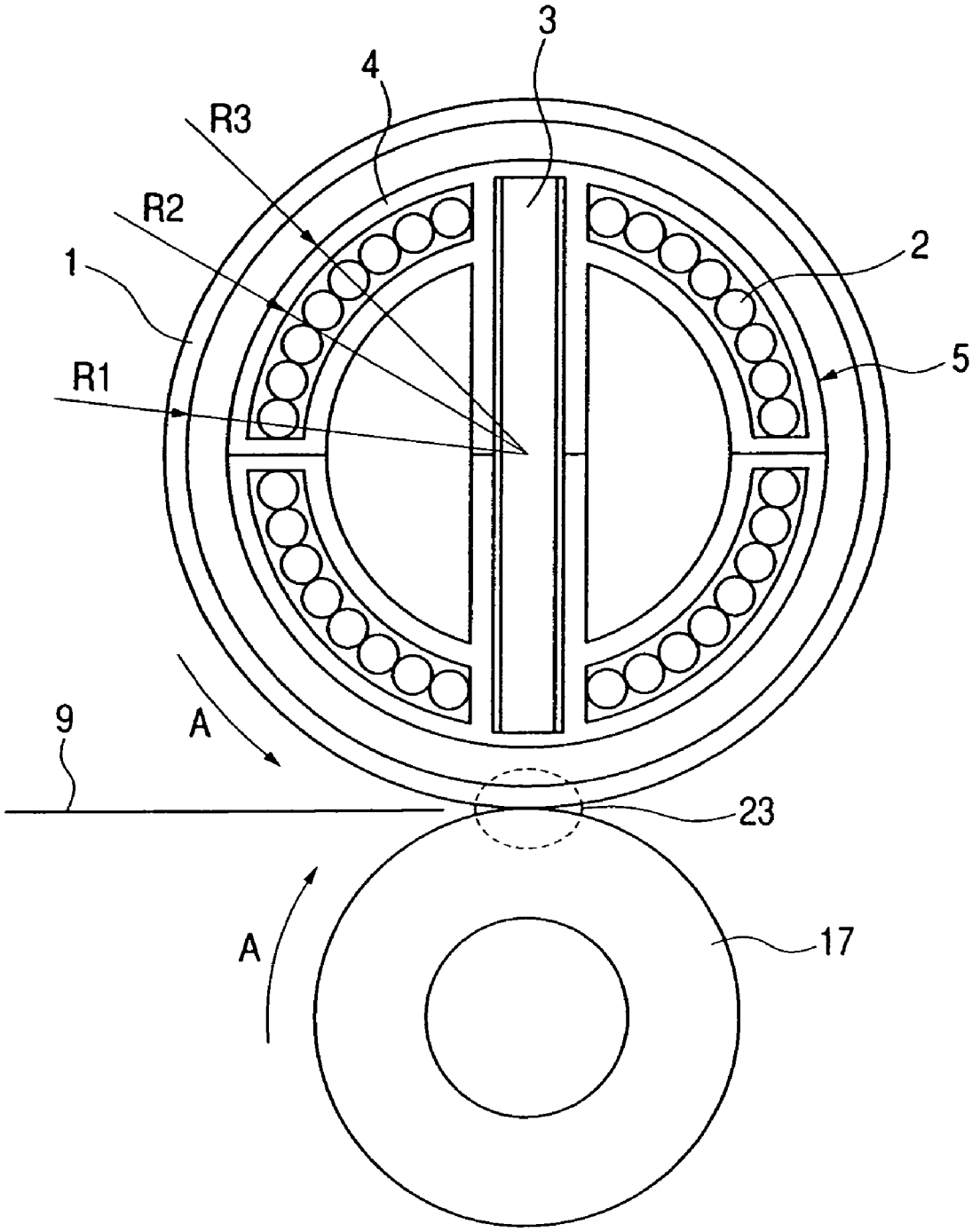
FIG. 1 is a schematic sectional view of a heating apparatus according to Embodiment 1.
Figure 2:
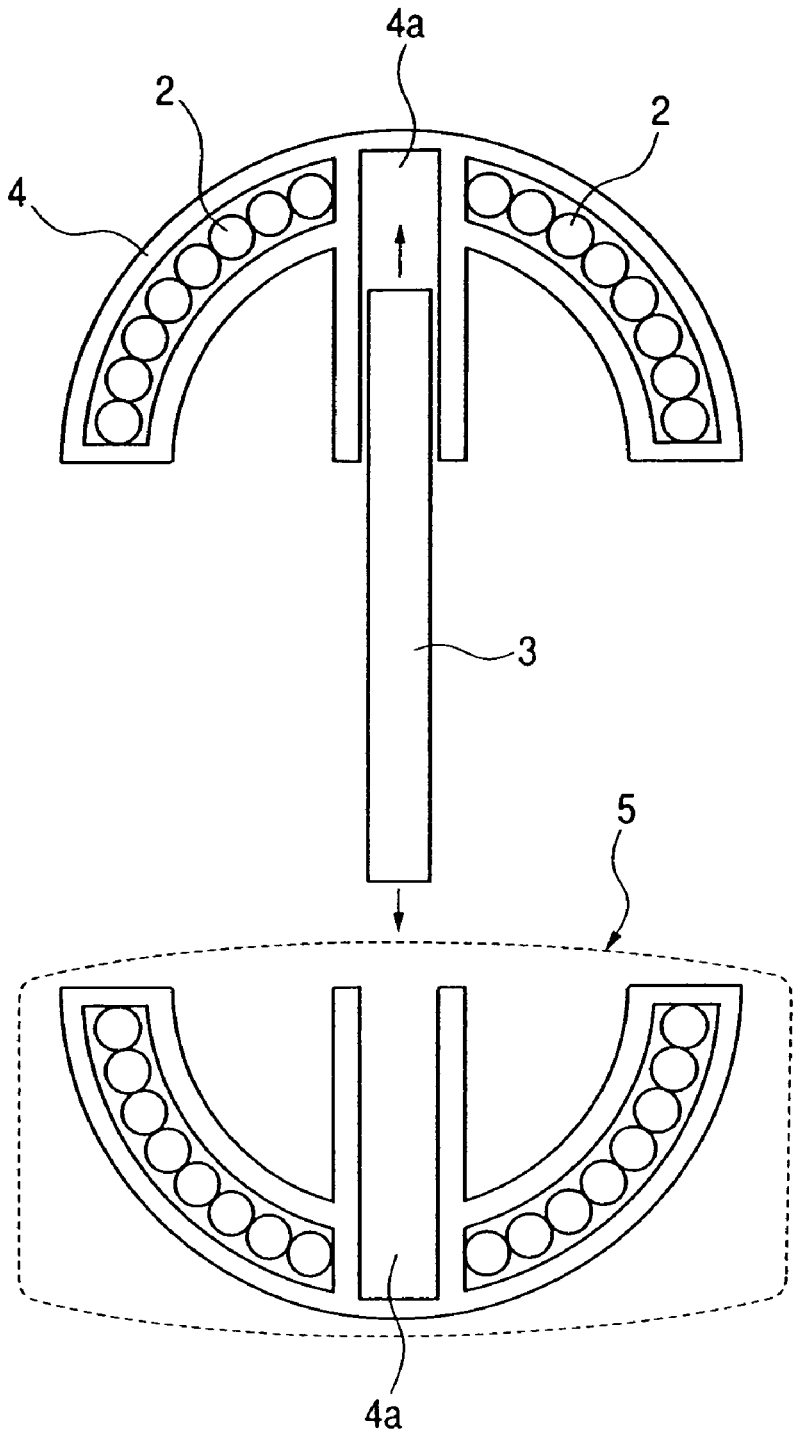
FIG. 2 is a schematic sectional view of two coil units according to Embodiment 1.

A description is given with reference to FIGS. 1 and 2 on a heating apparatus and its two coil units according to this embodiment. In FIG. 1, a heating roller 1 is a cylindrical electroconductive member (heating member) and is supported in a manner that allows the heating roller 1 to rotate about the central axis of the cylinder. The electroconductive member constituting the heating roller 1 is an iron, nickel, stainless steel, or other member that has magnetic characteristics.

Inside the heating roller 1, two semi-cylindrical coil units (a first coil unit and a second coil unit) 5 are joined together to form an approximately cylindrical (or columnar) shape since the cross-section of each of the first coil unit and the second coil unit is arced, and the resultant cylinder is centered on the rotation axis of the heating roller 1. The combined coil units are fixed to a side plate (not shown) of the heating apparatus and thus prevented from rotating. The resultant coil is a litz wire wound several times, and the litz wire is obtained by binding together plural copper wire strands whose surfaces are covered and insulated.

A pressurizing roller 17 is composed of a metal core and a silicon rubber or other rubber layer that is formed around the metal core. The pressurizing roller 17 is placed in parallel to the heating roller 1 and is pressed against the heating roller at a given pressure level. The heating roller 1 and the pressurizing roller 17 are both rotated in the direction of an arrow A by a rotational force provided from a rotation driving device (not shown). Through the rotation, a linear contact portion 23 is created between the heating roller 1 and the pressurizing roller 17, and such contact portion 23 is called a nip portion.

The coil units 5 are each composed of a coil 2 for generating a magnetic field and a holder 4 made of liquid crystal polymer resin. The holder 4 and the coil 2 are unitarily formed. To elaborate, the first coil unit is composed of a first holder and a first coil that is sealed in the first holder whereas the second coil unit is composed of a second holder and a second coil that is sealed in the second holder. The material of the holder 4 is not limited to liquid crystal polymer resin and can be phenol resin or other substance that is heat-resistant and heat-insulating and that has rigidity.

A face of the coil 2 that opposes the heating roller constitutes a part of a cylinder whose axis extends in the direction perpendicular to the axis around which the coil is wound. In the bundled conductor that constitutes the coil 2, a region that faces the inner surface of the heating roller 1 is approximately parallel to the bus line of the heating roller. The outer radius of the coil 2 is denoted by R2, and is slightly smaller than a radius R1, which is the inner radius of the heating roller 1.

The overall shape of each coil unit is approximately semi-cylindrical. A radius R3 of the semi-cylinder is obtained by adding the thickness of the holder to the radius R2, and satisfies the relation R2<R3 <R1. According to this embodiment, every portion of the holder 4 that faces a member that may have a different electric potential has a thickness of 0.4 mm or more.

For that reason, R3 is larger than R2 by 0.4 mm or more. The arcs of the coil units 5 may not form a perfect circle when combined and, in this case, the above relation, R2<R3<R1, may not be satisfied.

A core 3, together with the coil 2 and the heating roller 1, constitutes a magnetic circuit. The core 3 is for efficiently introducing, to the heating roller 1, a magnetic field that is generated by energizing the coil 2, and is composed of a magnetic body such as ferrite.

In this embodiment, the core 3 is press-fit or inserted into a core holding hole 4*a* provided in one coil unit 5 and then is adhered as shown in FIG. 2. Thereafter, the opposite end of the core 3 is press-fit or inserted into the other coil unit 5 and then adhered. In this way, the two coil units 5 and the core 3 are fixed to one another.

Instead of fixing the two coil units 5 through the core 3 as described above, the holders 4 may be adhered or fastened with a screw to each other to fix the two coil units 5.

A direct contact between the coil units 5 is not always necessary, and there may be a space between the coil units or other member may be interposed between the coil units.

Although the two semi-cylindrical coil units 5 are joined to each other in this embodiment, other structures including one in which three or more fan-shaped coil units 5 are joined together may be employed.

The two coil units in this embodiment are connected in series to a high frequency driving power supply.

Figure 3:
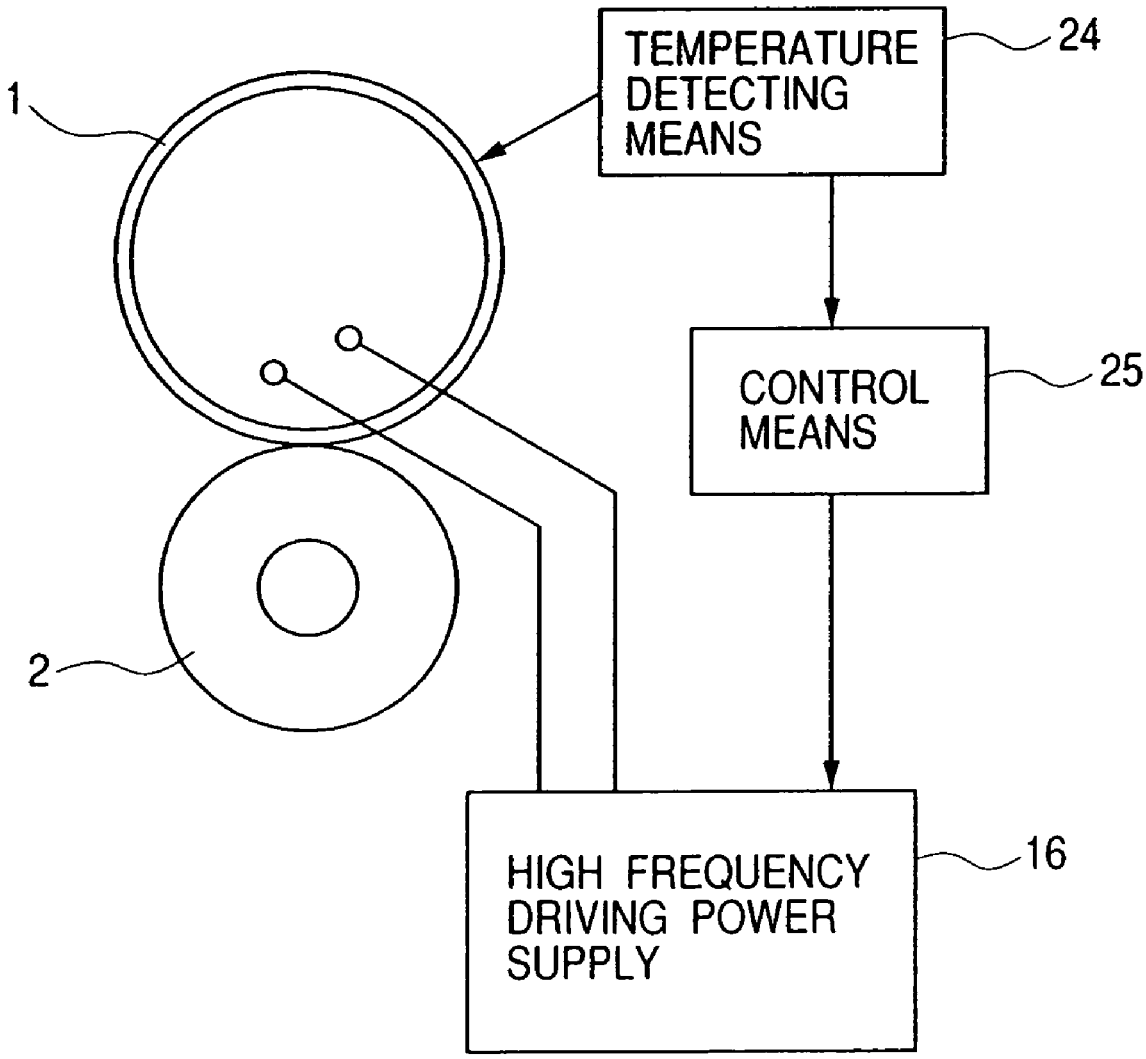
FIG. 3 is a schematic diagram of a control circuit for keeping the temperature of a heating roller at a set temperature.

The heating apparatus described above acts as follows:

As the heating apparatus starts its operation, an external high frequency driving power supply 26 shown in FIG. 3 applies a high frequency current (10 kHz to 1200 kHz) to the two coil units 5. The current application generates an alternating magnetic field in each coil 2. The alternating magnetic field is transmitted through the interior of the core 3, which is higher in magnetic permeability than air, and is applied through each end of the core 3 (meaning from two points) to the heating roller 1.

The alternating magnetic field causes an eddy current in the heating roller 1 following the principle of electromagnetic induction.

The heating apparatus in this embodiment utilizes Joule heat from the eddy current to make the heating roller 1 itself generate heat, which is used for toner fixing in an electrophotographic process or sheet surface treatment in an ink-jet process in a copying machine, a printer, or the like.

FIG. 3 is a schematic diagram of a control circuit for keeping the temperature of the heating roller 1 at a set temperature.

In FIG. 3, the temperature of the heating roller 1 is detected by temperature detecting means 24 and a detection signal from the temperature detecting means 24 is inputted to control means 25. The control means 25 turns on and off a current that is to be applied by the high frequency driving power supply 26 to the two coil units 5 so that the detection signal reaches a given value that corresponds to the set temperature. This on/off control method may be replaced by other control methods, and one of such methods is to control the electric power sent to the heating roller 1 by adjusting the phase angle.

The temperature of the heating roller 1 is kept at the set temperature by any control method given in the above. The set temperature is high enough to melt and fix toner onto a recording medium or to mainly melt a porous macromolecular layer of a sheet for surface treatment in an ink-jet process. For example, to fix toner onto a recording medium, the heating roller 1 is set to 160 to 200° C.

As a recording medium 9 passes through the nip portion 23 between the heating roller 1 that is well heated by the above method and the pressurizing roller 17, the toner fixing or surface treatment is accomplished by the pressure and heat from the two rollers.

Although this embodiment deals with a case of using the core 3, the same effect can be obtained without the core 3 if the distance between the heating roller 1 and the coil units 5 is closed so that enough magnetic fields are introduced to the heating roller 1.

The cylindrical electroconductive member in this embodiment is the metal heating roller 1. However, the same effect can be obtained when a metal film having the same magnetic characteristics, specifically, a flexible metal sleeve is employed instead of the heating roller 1.

The heating apparatus according to this embodiment has the coil units 5 each of which is composed of the coil 2 and the holder 4 which are unitarily formed, with the nonrigid coil 2 being supported by the holder 4. This makes it possible to avoid distortion of the coil 2 irrespective of the posture of the coil units 5 and thus obtain stable heat generation characteristics without changing the total electric impedance.

In addition, according to this embodiment, two or more coils can be combined with ease. Furthermore, since distortion of the coil 2 is avoided, the distance between the heating roller 1, which is a cylindrical electroconductive member, and the coil 2 can be kept constant while setting the distance from the heating roller to one coil 2 and to another coil 2 equal to each other. Also, the combined strength of the coil units 5 improves the ease of assembling work.

The holder 4 that encloses the coil 2 is formed from a liquid crystal polymer in this embodiment and therefore has sufficient heat resistance, heat insulating ability and rigidity. In addition, since a non-magnetic material is used for the holder 4, the holder 4 does not affect a magnetic field generated by the coil 2.

It has been found through research that, when making the heating roller 1 generate heat by induction heating, higher heat generation efficiency is obtained as a larger area of the coil 2 faces the heating roller 1. Therefore, it is preferable if a surface of the coil 2 that faces the heating roller 1, which is an approximately cylindrical electroconductive member, constitutes a part of a cylinder whose axis extends in the direction perpendicular to the axis around which the coil is wound as shown in this embodiment. In other words, it is preferable if, in the bundled conductor that constitutes the coil, a region that faces the inner surface of the heating roller is approximately parallel to the bus line of the heating roller. Also, the distance from the outer circumferential surface of the coil to the inner circumferential surface of the heating roller should be closed as much as possible considering the heat generation efficiency. In this way, the area of a region of the coil 2 that faces the heating roller 1, which is a cylindrical electroconductive member, is increased, resulting in high heat generation efficiency of the heating roller 1 and reduced power consumption of the heating apparatus.

It has also been found that the surface of the coil 2 that faces the inner surface of the heating roller 1 should be shaped to have a radius of curvature approximately equal to that of the fixing roller 1 in order to solve temperature unevenness along the longitudinal direction and similar problems. The structure of this embodiment is therefore effective against temperature unevenness in the longitudinal direction of the heating roller.

The holder 4 in this embodiment is 0.4 mm or thicker in every portion that faces a member that may have a different electric potential. This allows the holder 4 to serve as an insulating member between members that may be different in electric potential from each other, such as the heating roller 1 and the coil 2.

In addition, if a UL-approved product or a product approved by Electrical Appliance and Material Safety Law (former Electrical Appliance and Material Control Law) is used for the holder 4, the creepage distance of insulation can substitute for the necessary air clearance demanded by domestic and overseas regulations and thus design limitations are reduced.

Second Embodiment

Figure 4:
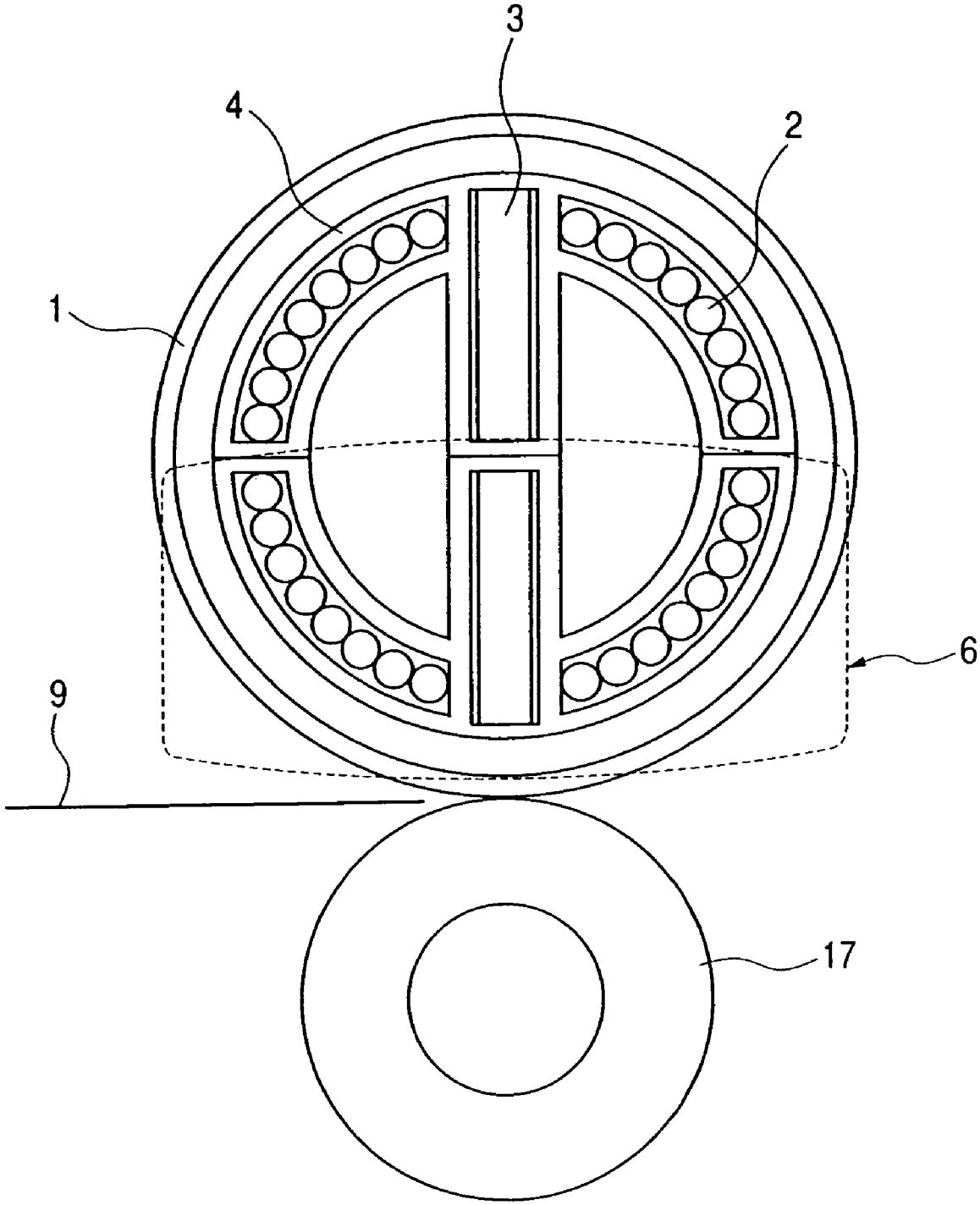
FIG. 4 is a schematic sectional view of a heating apparatus according to Embodiment 2.

FIG. 4 is a schematic sectional view of a heating apparatus according to a second embodiment.

In this embodiment, two coil core units (coil units) 6 are joined to each other, and each coil core unit is composed of a coil 2 for generating a magnetic field, a core 3 composed of a magnetic body, and a holder 4 made of phenol resin. The coil 2, the core 3, and the holder 4 are unitarily formed. For the rest, the heating apparatus of this embodiment and the heating apparatus of the first embodiment are structured similarly.

That is, the core 3 is added to the coil 2 and the holder 4 in integral molding to constitute the coil core unit 6 in this embodiment. This embodiment is thus improved in ease of assembling work as well as in work efficiency since the step of inserting the core 3 is eliminated.

This embodiment also has an effect of reducing problems brought around by the core rattling, such as chipping and a change in characteristic. The coil core units 6 are fixed by adhering, or fastening with a screw, the holders 4 to each other.

A direct contact between the coil core units 6 is not always necessary, and there may be a space between the coil core units or other member may be interposed between the coil core units.

Although the two semi-cylindrical coil core units 6 are joined to each other in this embodiment, other structures including one in which three or more fan-shaped coil core units 6 are joined together may be employed.

Third Embodiment

Figure 5:
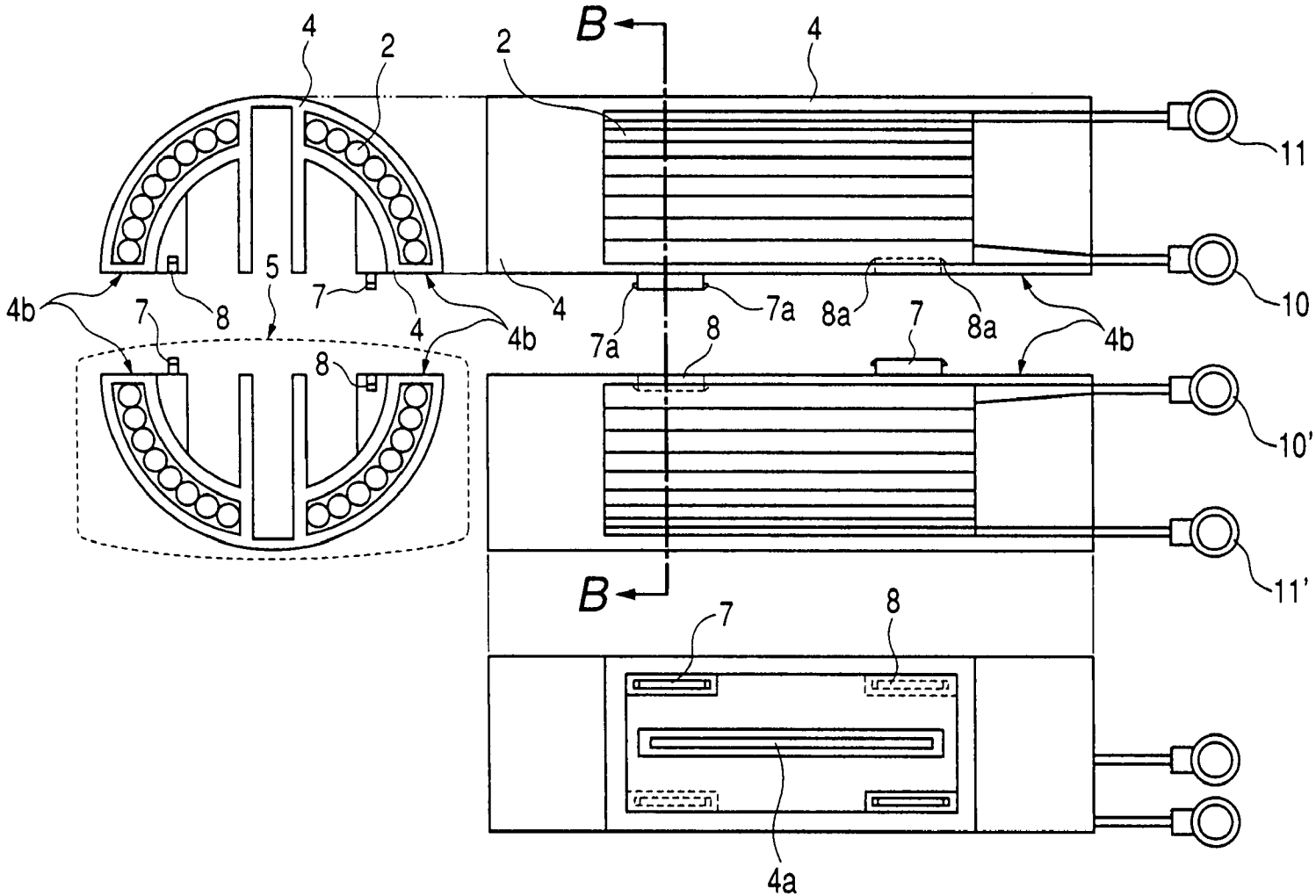
FIG. 5 is a schematic sectional view and side view of two coil units according to Embodiment 3 and a plan view of one of the coil units.

FIG. 5 is a schematic sectional view of two coil units 5 of a third embodiment taken along a line B—B, a side view of the two coil units, and a plan view of one of the coil units.

In the third embodiment shown in FIG. 5, each coil unit 5 has an approximately semi-cylindrical shape and includes a holder 4. The coil units 5 are joined to each other at surfaces 4*b* of each holder 4. Two convex holding portions 7 are arranged diagonally from each other and two concave holding portions 8 are arranged diagonally from each other in the vicinity of four corners of the surface 4*b*. The convex holding portions and the concave holding portions are referred to as junction portions.

Each convex holding portion 7 is an approximately rectangular column that protrudes vertically from the associated surface 4*b*. A claw 7*a* is provided in each side face in the coil unit cylinder axis direction of the rectangular column. Each convex holding portion 7 is inserted into the associated concave holding portion 8 opened in the associated surface 4*b* as the surfaces 4*b* of one coil unit 5 are joined to the surfaces 4*b* of the other coil unit 5. The hole shape of each convex holding portion conforms to the shape of each concave holding portion. A fit portion 8*a* into which the claw 7*a* is fit is provided far back in each concave holding portion.

Similar to the first embodiment and the second embodiment, the coil units 5 of this embodiment are each composed of a coil 2 and the holder 4 made of liquid crystal polymer resin which are unitarily formed. However, in this embodiment, the convex holding portions 7 and the concave holding portions 8 are formed as a part of the holder 4 upon unitarily forming the holder 4 and the coil 2.

The two convex holding portions and two concave holding portions of the upper holder 4 and the two convex holding portions and two concave holding portions of the lower holder 4 are fit into one another to join the coil units 5 together. This makes it possible to join the two coil units 5 to each other more solidly without adhering or screw-fastening and to hold and fix the coil units in the solidly joined state. Thus the product cost can be reduced and the reliability is improved.

Moreover, the number of parts can be reduced since the convex holding portions 7 and the concave holding portions 8 are formed upon unitarily forming the holder 4 and the coil 2. In addition, since the identical coil units 5 constitute an upper coil unit and a lower coil unit, erroneous assembling can be avoided. Alternatively, convex holding portions 7 and the concave holding portions 8 may be formed separately from the holder 4 to be later attached to the holder 4.

The convex holding portion 7 and the concave holding portion 8 are not limited to the shapes given in this embodiment, and may have other shapes as long as they can function as a holding portion for securely holding and fixing two or more coil units 5. The coil unit 5 of this embodiment may be replaced by the coil core unit 6.

Fourth Embodiment

Figure 6:
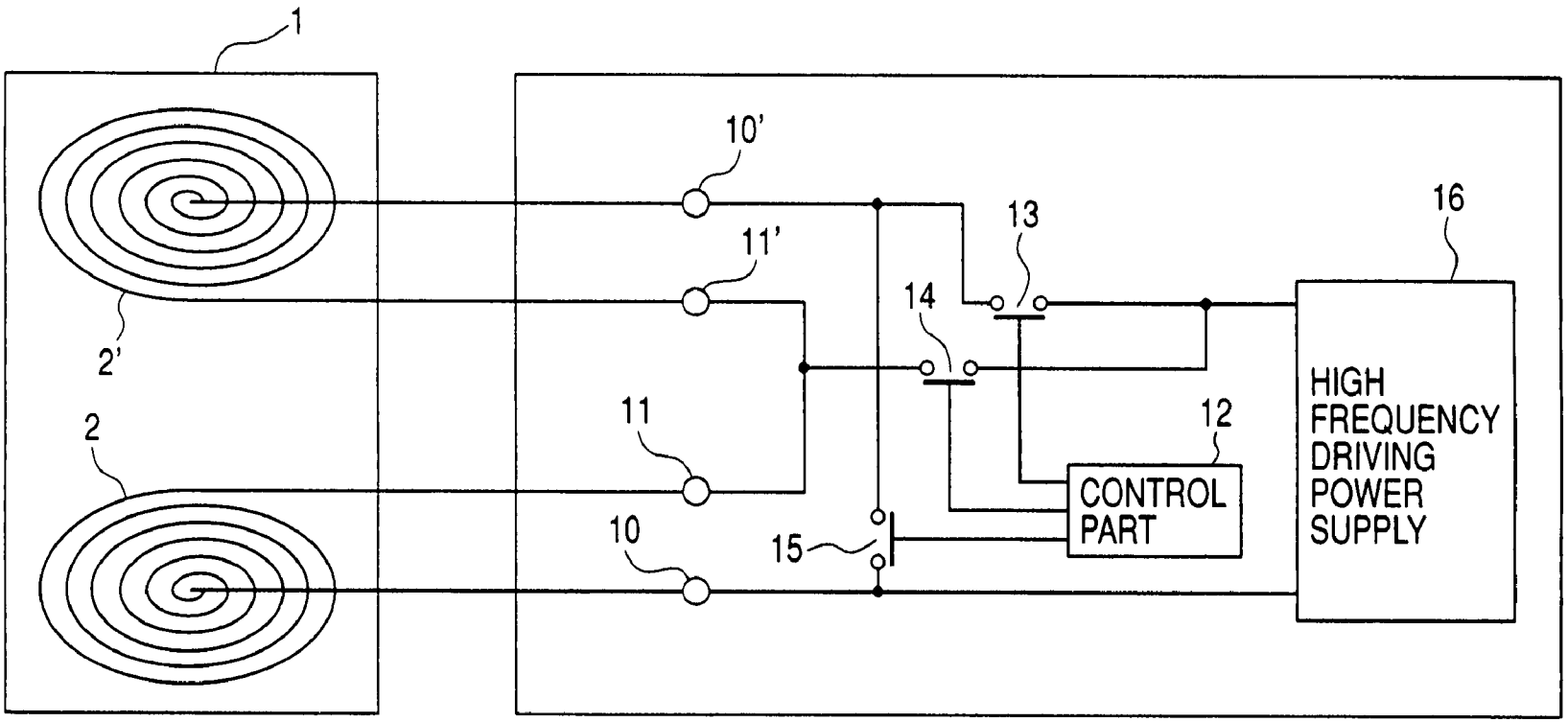
FIG. 6 is an electric equivalent circuit of a heating apparatus according to Embodiment 4.

FIG. 6 is an electric equivalent circuit of a heating apparatus according to a fourth embodiment.

A coil 2 and a coil 2' are placed in the vicinity of a heating roller 1. Wind start terminal portions 10 and 10' and wind end terminal portions 11 and 11' of the coils 2 and 2' have terminal portions outside of the fixing roller (heating roller) 1, and the terminal portions are independent of one another.

The structure of this embodiment eliminates laborious works required in a coil that is obtained by joining two or more coil units together at a junction portion, such as connecting the coils 2 and 2' to each other. As a result, the mass producibility is improved and the heating apparatus becomes easy to handle. The structure of this embodiment also prevents the temperature of a junction portion, which is placed in the vicinity of the heating roller, from rising high since the terminal portions are apart from the heating roller and heat of the heating roller does not reach the junction portion.

The wind start terminal portions 10 and 10' and wind end terminal portions 11 and 11' of the coils 2 and 2' are electrically connected to a high frequency driving power supply 16.

In this embodiment, switches 13, 14 and 15 and a control part 12 are provided as switching means for switching connection of the terminal portions 10, 10', 11, and 11'.

The switching means switches connection of the coils 2 and 2' from serial to parallel or from parallel to serial, thereby changing a magnetic field and controlling the amount of heat generated.

The coils 2 and 2' are connected in series by turning the switch 13 on while turning the switches 14 and 15 off. When the switch 13 is turned off whereas the switches 14 and 15 are turned on, the coils 2 and 2' are connected in parallel. The switches 13, 14 and 15 are controlled with signals outputted from the control part 12.

With the structure of this embodiment, the amount of heat generated can readily be controlled by changing how the coils are connected. Although identical coils are used in this embodiment, different coils may be employed. As a result, the amount of heat generated can be controlled with higher precision.

Fifth Embodiment

Figure 7:
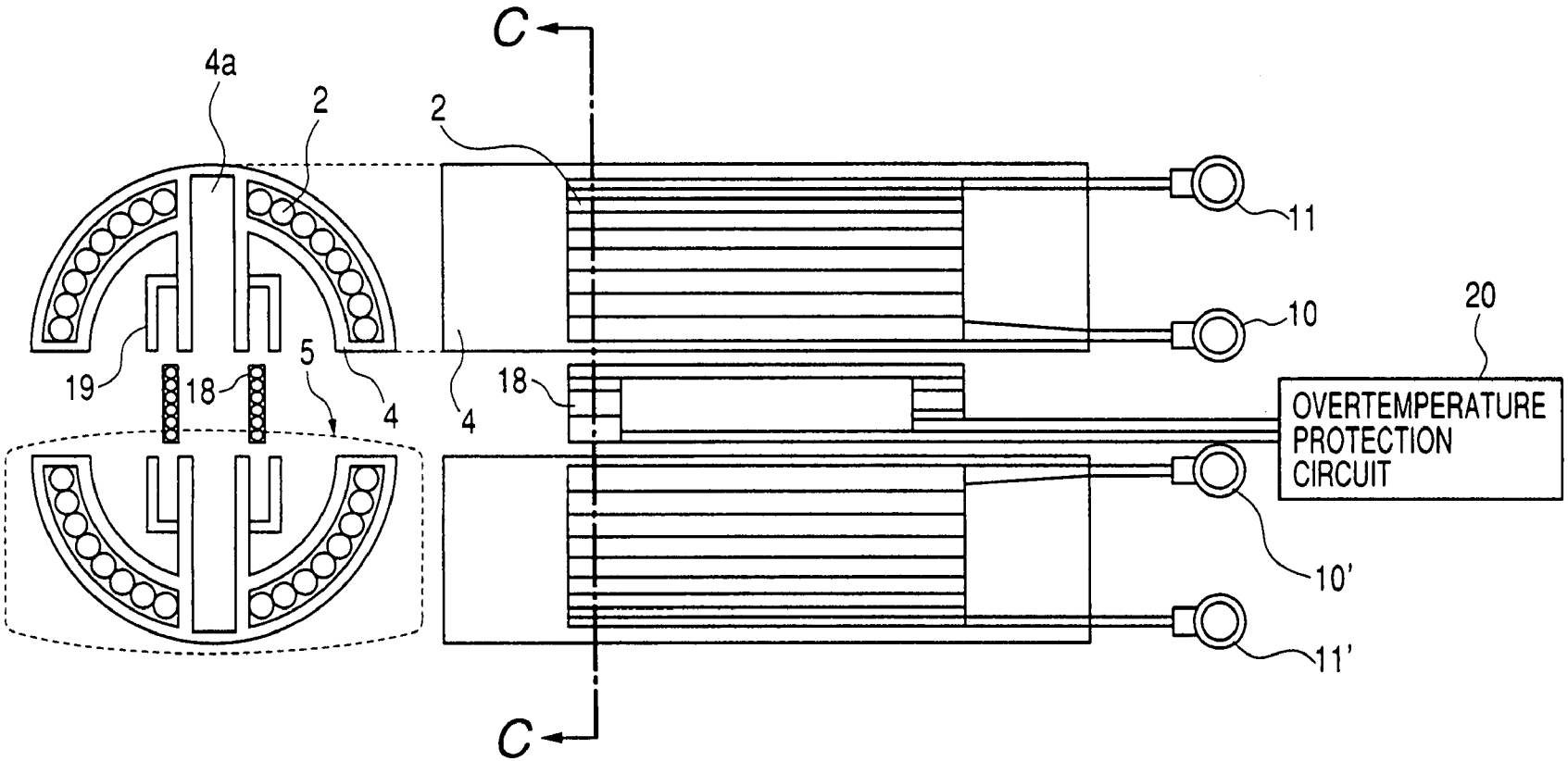
FIG. 7 is a schematic sectional view and side view of two coil units according to Embodiment 5.

FIG. 7 is a schematic sectional view of two coil units 5 of a fifth embodiment taken along a line C—C, and a side view thereof. In FIG. 7, two auxiliary coils 18 are placed in the vicinity of ends in the axial direction of a heating range that is heated by coils 2. The auxiliary coils 18 are provided to generate magnetic fields that cancel the magnetic fields generated by the coils 2.

In this embodiment, a core (not shown in the drawing) is divided into three in the axial direction of the two coil units 5. The two core sections at the ends each pierce the coil center of the corresponding auxiliary coil, thus introducing magnetic fields that are generated by the coils 2 and magnetic fields that are generated by the auxiliary coils 18 both to a heating roller 1.

Similarly, a core setting hole 4*a* in each holder 4 is divided into three so that all of the above three core sections can be held in their respective setting holes. The holders 4 have auxiliary coil holding portions 19, which sandwich and hold the auxiliary coils 18 when joining the two coil units to each other.

The heating apparatus in this embodiment operates as follows.

For instance, when the width of a recording medium 9 is smaller than the heating range of the heating apparatus according to this embodiment, the recording medium 9 draws heat of the heating roller 1 in a paper passing region where the recording medium 9 passes the heating roller 1, causing a temperature drop in the paper passing region.

The dropped temperature in the paper passing region is restored through the work of temperature detecting means 24 and control means 25 by increasing a current flow from a high frequency driving power supply to the coils 2. The temperature in the paper passing region is thus raised to a set temperature, while raising the temperature of other regions than the paper passing region past the set temperature since the recording medium does not draw heat from those regions.

At this point, an over temperature protection circuit 20 supplies, to the auxiliary coils 18 a current that generates magnetic fields of the opposite direction to the direction of the magnetic fields generated by the coils 2. This cancels application of the magnetic fields by the coils 2 to the heating roller 1 and, as a result, an excessive temperature rise of the heating roller is prevented in the regions other than the paper passing region.

This embodiment structured as described above is capable of preventing an excessive temperature rise in other regions than a paper passing region of a recording medium when the paper passing region is smaller than the heating range of the heating apparatus, or in similar cases.

With the auxiliary coil holding portions 19 provided in advance in the coil units 5, the auxiliary coils 18 can operate while stably positioned in place and the ease of assembling work is improved as well.

If the auxiliary coil 18 and the coil unit 5 are unitarily formed, the ease of work is improved even more. The coil unit 5 of this embodiment may be replaced by the coil core unit 6, of course. Entire Structure of an Image Forming Apparatus A heating apparatus according to an embodiment of the present invention is suitably applied to an image forming apparatus such as a copying machine.

The description given below is about a case of applying a heating apparatus of the present invention as a fixing apparatus provided in an electrophotographic image forming apparatus.

To outline this application, an unfixed toner image is formed on a sheet by a known electrophotographic process, and then the fixing apparatus heats and pressurizes the sheet to fix the toner image.

The heating apparatus serving as a fixing apparatus in the description below can also be used, without changing anything, as a surface treatment apparatus for performing surface treatment on a sheet on which a porous macromolecular layer is formed.

To outline this application, an image is formed by an ink jet method on a sheet that has a porous macromolecular layer, and then the surface treatment apparatus heats the sheet to melt the porous macromolecular layer for surface treatment.

Described below are a case of applying a heating apparatus of the present invention to a laser printer and a case of applying a heating apparatus of the present invention to a copying machine as an example of an apparatus that is equipped with both an image reading apparatus and an image forming apparatus.

Figure 8:
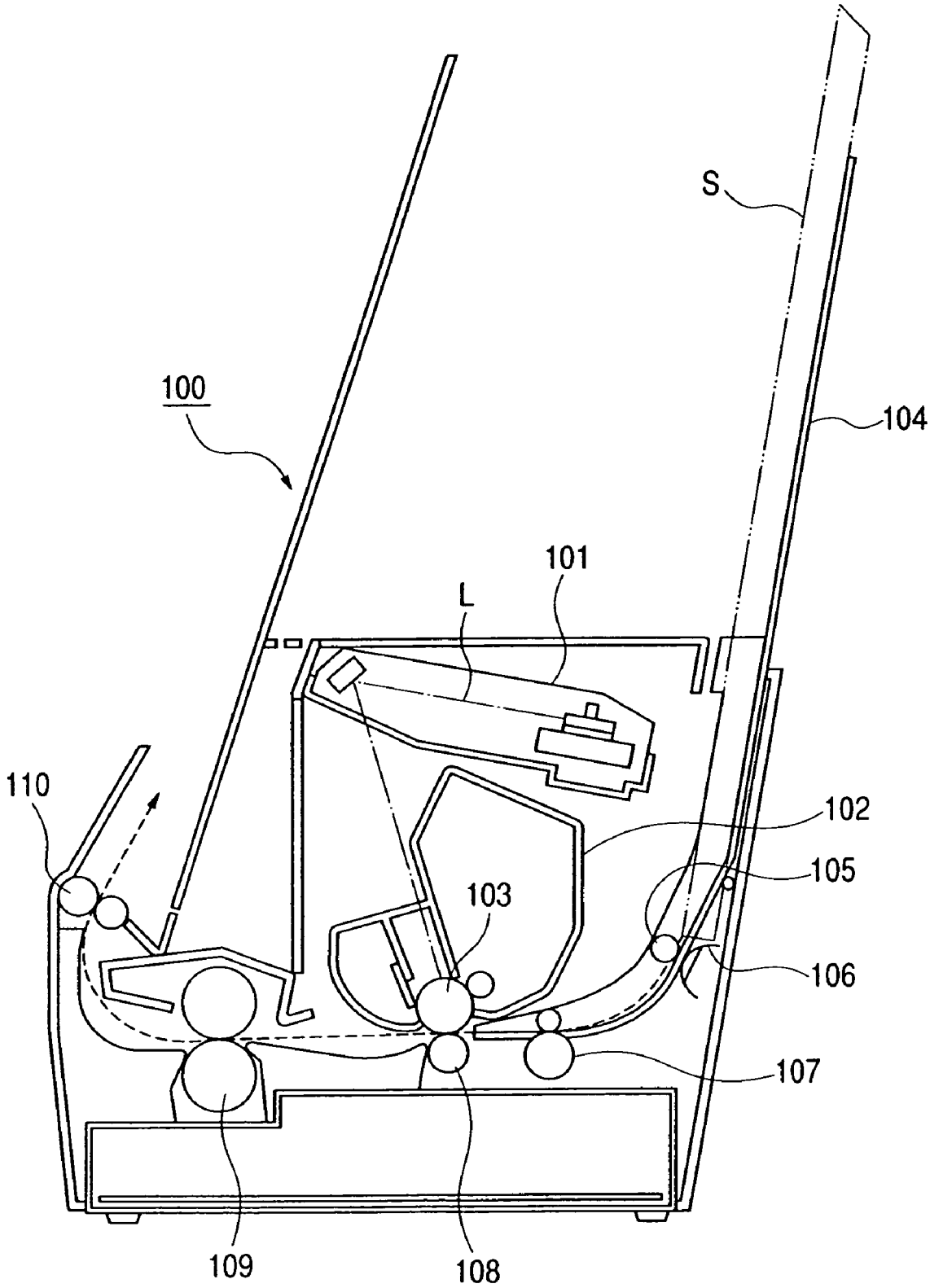
FIG. 8 is a structural sectional view schematically showing the entire structure of an image forming apparatus of a printer.

Application of a heating apparatus to a laser printer is described first with reference to FIG. 8.

FIG. 8 is a schematic structural diagram of a laser printer.

An outline of the laser printer is given first. As shown in FIG. 8, a laser printer 100 has a laser scanner 101, which emits a laser beam L based on image information sent from a personal computer or the like. The laser beam L is radiated onto a photosensitive drum 103 built in a process cartridge 102, which constitutes image forming means.

This causes the photosensitive drum 103 to form a latent image on its surface, and the latent image is developed by the process cartridge 102 using toner.

Sheets S stacked on a sheet stacking tray 104 are separated and fed one by one by a feeding roller 105 and a separating pad 106. A transport roller 107 sends a sheet further to the downstream and the toner image formed on the photosensitive drum 103 is transferred onto the transported sheet by a transfer roller 108.

The sheet on which the unfixed toner image is formed is further transported to the downstream until it reaches a fixing apparatus 109, where the toner image is fixed. Thereafter, the sheet is discharged to the outside of the printer by a delivery roller 110.

Next, application of a heating apparatus to a copying machine is described with reference to FIG. 9.

Figure 9:
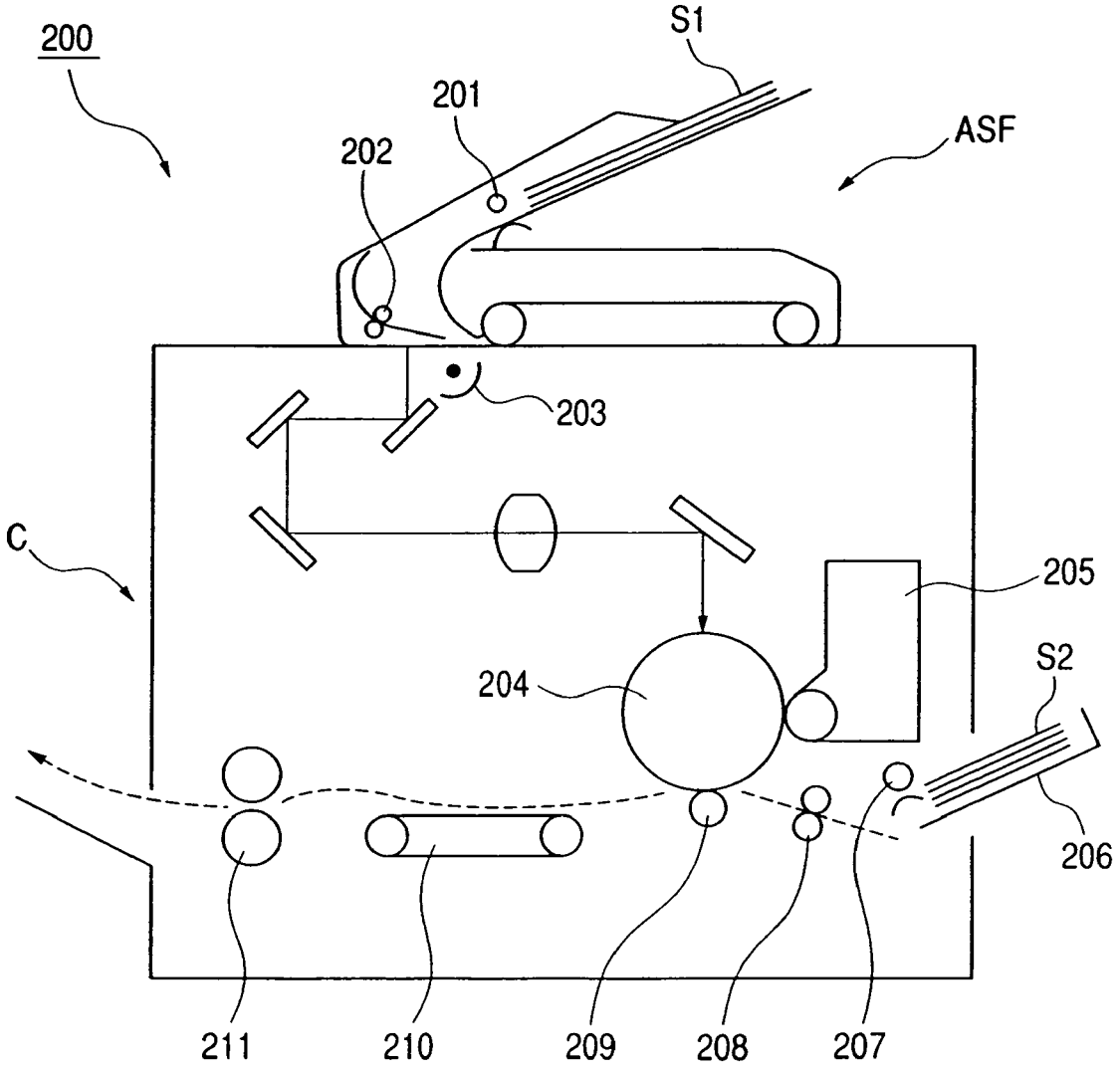
FIG. 9 is a structural sectional view schematically showing the entire structure of an image forming apparatus of a copying machine.
Figure 10:
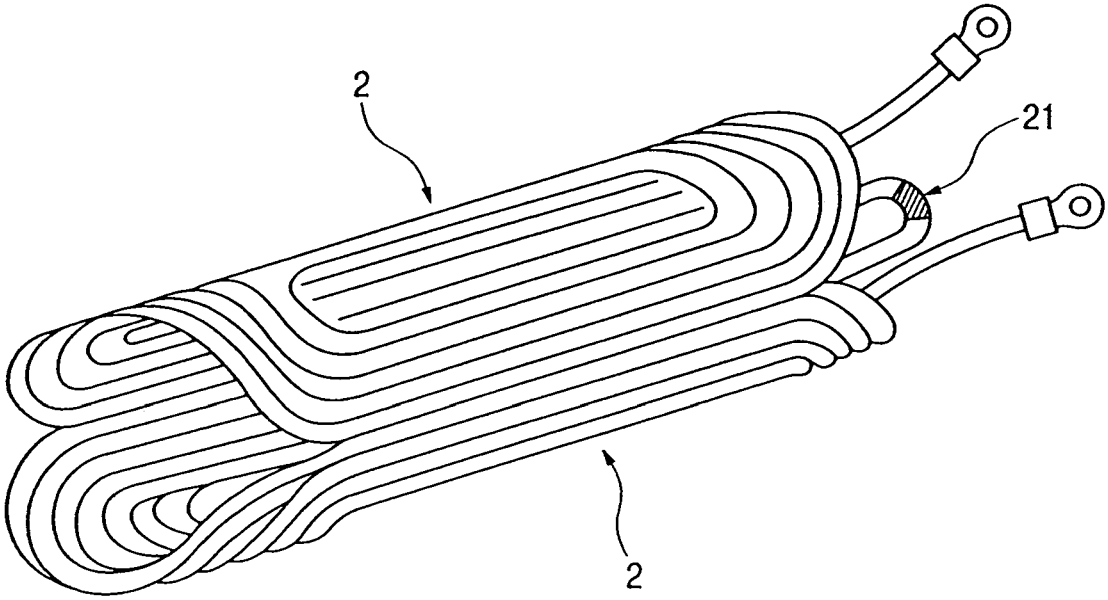
FIG. 10 PRIOR ART
FIG. 10 is a perspective view of a coil according to a prior art example.

FIG. 9 is a schematic structural diagram of a copying machine.

An outline of the copying machine is given first. As shown in FIG. 9, a copying machine 200 is composed of an original reading unit and an image forming apparatus unit C. The original reading unit includes an ASF (auto sheet feeder) for transporting an original sheet S1. The image forming apparatus unit C forms an image on a sheet based on image information read.

Original sheets S1 stacked in the ASF are separated by a separating roller 201 and fed one by one to the original reading unit by a feeding roller 202.

An illumination source 203 irradiates the original with light to read an image and the obtained image light is led to a photosensitive drum 204 through plural reflection mirrors or the like.

This causes the photosensitive drum 204 to form on its surface a latent image of the image read. After that, the latent image is developed by a developing unit 205.

Sheets S2 stacked on a sheet stacking tray 206 are separated by a separating roller 207 and fed one by one by a transport roller 208. The toner image formed on the photosensitive drum 204 is transferred onto the sheet S2 by a transfer roller 209, and the sheet S2 is transported further by a conveyor belt 210.

The toner image is fixed by a fixing apparatus 211. Thereafter, the sheet S2 is discharged to the outside of the copying machine by a delivery roller (not shown).

The fixing apparatus used in this structure is a thermal fixing apparatus that melts with heat a toner image transferred onto a recording medium such as recording paper or an OHP sheet or other transfer material to fix the toner image to the recording medium.

If a heating apparatus according to the present invention is used as the fixing apparatus 109 or 211, a low-cost image forming apparatus is obtained which is improved in ease of assembling the heating apparatus, which is reduced in power consumption, which does not generate heat wastefully, and which can provide stable image fixing characteristics or surface treatment.

The present invention is not limited to the examples given above but includes various modifications that can be conceived by those skilled in the art.

What is claimed is:

1. An image heating apparatus comprising:

a cylindrical heating member;

a first coil unit provided in said cylindrical heating member, for generating a magnetic field to induce an eddy current in said heating member, wherein said first coil unit comprises a first excitation coil sealed in a first holder made of resin, the first holder including a concave portion;

a second coil unit provided in said cylindrical heating member, for generating a magnetic field to induce an eddy current in said heating member, wherein said second coil unit comprises a second excitation coil in a second holder made of resin, the second holder including a concave portion; and a core bound between the concave portion of the first holder and the concave portion of the second holder.

2. An image heating apparatus according to claim 1, wherein a cross-section of each of said first coil unit and said second coil unit is arced, and wherein said first coil unit and said second coil unit form an approximately cylindrical shape or an approximately columnar shape when combined.

3. An image heating apparatus according to claim 1, wherein said heating member has a cylindrical shape, and wherein, in bundled conductors that constitute said first excitation coil and said second excitation coil, regions that face said heating member are approximately parallel to a bus line of said heating member.

4. An image heating apparatus according to claim 1, wherein said first holder and said second holder each has a junction portion to be connected to each other.

* * * * *

UNITED STATES PATENT AND TRADEMARK OFFICE

CERTIFICATE OF CORRECTION

PATENT NO. : 7,034,261 B2
APPLICATION NO. : 11/121019
DATED : April 25, 2006
INVENTOR(S) : Hitoshi Suzuki It is certified that error appears in the above-identified patent and that said Letters Patent is hereby corrected as shown below:

On Title Page, Col 2 Item [57] Abstract:
Line 3, "excitation,coil" should read --excitation coil--.

COLUMN 7:
Line 43, "works" should read --work--.

COLUMN 10:
Line 64, "has" should read --have--.

Signed and Sealed this

Fourteenth Day of November, 2006

JON W. DUDAS
*Director of the United States Patent and Trademark Office*